US007630674B2

(12) United States Patent
Behnke et al.

(10) Patent No.: US 7,630,674 B2
(45) Date of Patent: Dec. 8, 2009

(54) METHOD AND ARRANGEMENT FOR FUSING TONER IMAGES TO A PRINTING MATERIAL

(75) Inventors: Knut Behnke, Flintbeck (DE); Hans-Otto Krause, Eckernfoerde (DE); Frank-Michael Morgenweck, Kiel (DE); Domingo Rohde, Kiel (DE); Detlef Schulze-Hagenest, Molfsee (DE)

(73) Assignee: Eastman Kodak Company, Rochester, NY (US)

( * ) Notice: Subject to any disclaimer, the term of this patent is extended or adjusted under 35 U.S.C. 154(b) by 344 days.

(21) Appl. No.: 10/583,163

(22) PCT Filed: Dec. 16, 2004

(86) PCT No.: PCT/EP2004/014353

§ 371 (c)(1),
(2), (4) Date: Feb. 22, 2007

(87) PCT Pub. No.: WO2005/059658

PCT Pub. Date: Jun. 30, 2005

(65) Prior Publication Data

US 2007/0280751 A1 Dec. 6, 2007

(30) Foreign Application Priority Data

Dec. 18, 2003 (DE) ..... 103 59 666

(51) Int. Cl.
*G03G 15/20* (2006.01)

(52) U.S. Cl. ..... 399/322; 399/336

(58) Field of Classification Search ..... 399/322, 399/336, 337, 341
See application file for complete search history.

(56) References Cited

U.S. PATENT DOCUMENTS

| | | | | |
|---|---|---|---|---|
| 5,058,880 | A | 10/1991 | McGraw et al. | |
| 5,098,080 | A | 3/1992 | Arnone et al. | |
| 5,194,558 | A | 3/1993 | Carlston et al. | |
| 5,256,507 | A | 10/1993 | Aslam et al. | |
| 5,557,388 | A | 9/1996 | Creutzmann et al. | |
| 5,805,969 | A | 9/1998 | Elsermans et al. | |
| 6,226,474 | B1 * | 5/2001 | Kowalski et al. | 399/92 |
| 2002/0191993 | A1 | 12/2002 | Bartscher et al. | |
| 2003/0013034 | A1 | 1/2003 | Behnke et al. | |

FOREIGN PATENT DOCUMENTS

| | | |
|---|---|---|
| EP | 0 867 394 A1 | 9/1998 |
| FR | 2 760 733 | 3/1997 |

* cited by examiner

*Primary Examiner*—Hoang Ngo
(74) *Attorney, Agent, or Firm*—Peyton C. Watkins

(57) ABSTRACT

An object of the present invention is to produce a suitable printed image in a printing machine and provide efficient cooling of the printing material following a fusing operation. To do so, a method for fusing toner to a printing material (5) is provided, in which case the printing material (5) is guided in a contacting manner below the toner's glass transition temperature and in a non-contacting manner above the toner's glass transition temperature. Furthermore, a fusing arrangement (1) is provided, which comprises at least one device (3) for guiding the printing material (5) in a contacting manner below the toner's glass transition temperature and at least one device (12) for guiding the printing material (5) in a noncontacting manner above the toner's glass transition temperature.

8 Claims, 1 Drawing Sheet

METHOD AND ARRANGEMENT FOR FUSING TONER IMAGES TO A PRINTING MATERIAL

Figure 1:
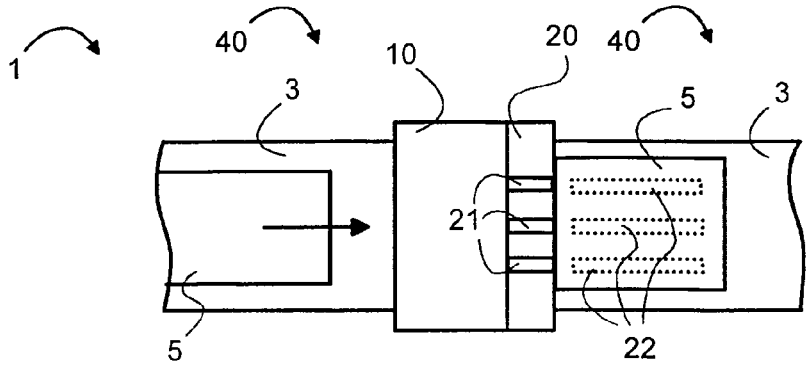

The present invention relates to a method in accordance with the preamble of Claim 1 and to a fusing arrangement in accordance with the preamble of Claim 6.

One of the method steps for printing with the use of printing machines involves the application of toner to the printing material and the subsequent fusing or fixing of the toner on the printing material in such a manner that the toner will not smear. To achieve this, there are methods which use an apparatus that employs pressure and heat to the printing material, hereinafter referred to as contacting processes, and those methods which do not involve any contact with the printing material, for example, those using microwave radiation, hereinafter referred to as contactless or also non-contact processes. In conjunction with this, there are fundamental problems, namely that the printing material carrying the toner is still hot after being heated, and that the toner may smear easily. Therefore, cooling arrangements are provided which are used to cool the printing material to which the applied toner has been applied.

One object of the present invention is to provide a suitable printed image in a printing machine.

Another object of the invention is to provide efficient cooling of the printing material following the fusing process.

These problems have been solved in accordance with the features of Claims 1 and 6.

Provided hereinafter is a method for fusing toner to a printing material, whereby the printing material is guided in a contacting manner below the toner's glass transition temperature, and the printing material is guided in a non-contacting manner above the toner's glass transition temperature.

Furthermore, a fusing arrangement is provided, in particular a fusing arrangement for carrying out the method as in Claim 1, which said arrangement comprises at least one device for guiding the printing material in a contacting manner below the toner's glass transition temperature, and at least one arrangement for guiding the printing material in a non-contacting manner above the toner's glass transition temperature. The fusing process and a subsequent cooling process take place in such a manner that the toner image on the printing material is not damaged in any way.

Forms of embodiment of the present invention are described in the subclaims.

In one form of embodiment, a cooling arrangement cools a printing material area-by-area or section-by-section, so that less cooling energy is used. Only those areas or sections are cooled in which the printed image is subject to potential damage by printing machine parts.

Advantageously, the cooling arrangement cools strips of the printing material so that transport rollers used for transport can come into contact with the cooled strips without damaging the printed image. Areas of the printed image, which initially will not be in contact with the transport rollers of the printing machine, are at least not cooled initially and, accordingly, will cool somewhat more slowly. This embodiment is advantageous, for example, because it uses a specific amount of cooling medium available for cooling in a particularly effective manner only in the area of said strips.

In one form of embodiment, a stream of a cooling medium is directed at the printing material in transport direction of the printing material, so that the velocity of the printing material is affected, i.e., specifically a constant velocity of the printing material is maintained as it passes through a fusing arrangement and a subsequent cooling arrangement. Consequently, as a result of this constant velocity, the printing result is of consistent quality because fusing heat is constantly applied to the printing material carrying the toner.

In another form of embodiment, a narrow, unprinted, i.e., not carrying a toner image, front section (viewed in transport direction) of the printing material is grasped by a gripper, while the printed rear section of the printing material is guided in a non-contacting manner.

Advantageously, an arrangement is designed for guiding the printing material in a non-contacting manner at the heating arrangement. This permits a compact design.

Advantageously, the cavity of the microwave resonator is provided with a dielectric material, in particular polytetrafluoroethylene. By doing this, microwave absorption and energy loss in the fusing arrangement are minor.

In order to prevent damaging or smearing the printed image, an air cushion is provided for transporting the printing material. Furthermore, the paper path, along which the printing material is transported, may be aligned perpendicularly, or almost perpendicularly, in a downward direction by an air cushion arrangement, and the heating arrangement is located along the perpendicularly, or almost perpendicularly, downward directed paper path. The printing material is accelerated by gravity and is guided by the air cushion of the air cushion arrangement. In case the paper path is designed at an angle of less than 90 degrees relative to the horizontal, the air cushion is provided only on the underside of the printing material.

A preferred form of embodiment comprises at least one gripper, in particular, preferably a vacuum gripper for attracting the printing material by means of the vacuum and for guiding the printing material through the heating arrangement, in which case the printing material is moved through the heating arrangement at a velocity that is suitable for the fusing process. Preferably, the printing material is grasped by the gripper when the printing material leaves the fusing arrangement.

Another suggestion for a solution to providing a defined velocity for fusing the toner to the printing material, and, optionally, for transport in a non-contacting manner through the subsequent cooling arrangement, is a pushing element for pushing the printing material through the fusing arrangement and through the cooling arrangement, the latter potentially including said fusing arrangement.

Yet another form of embodiment comprises at least one heating arrangement aligned at an angle vertical to the transport direction of the printing material, preferably at an angle of 29 degrees. As a result of this feature, the paper guiding operation is improved because, as a result of the inclined position of the heating arrangement, optionally including the subsequent cooling arrangement, an already cooled area of the printing material can again come into contact with a transport belt, while a not yet heated other area of the printing material is still moved by the transport belt which carries the printing material.

Figure 2:
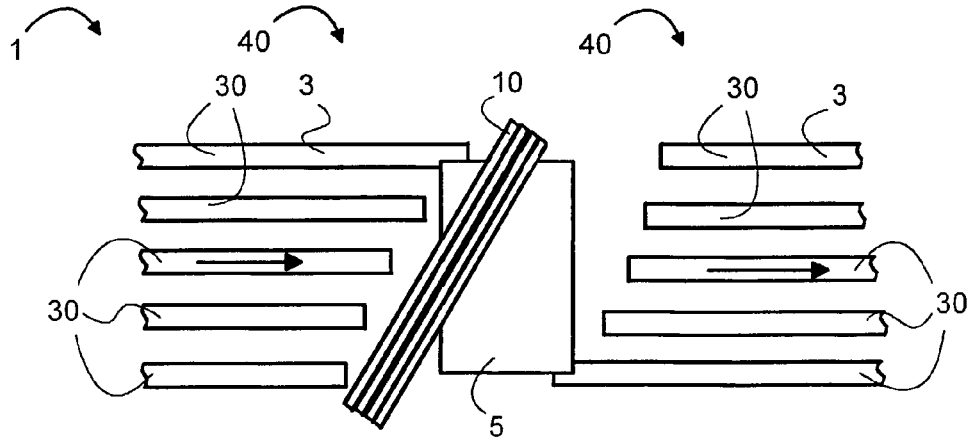
Figure 3:
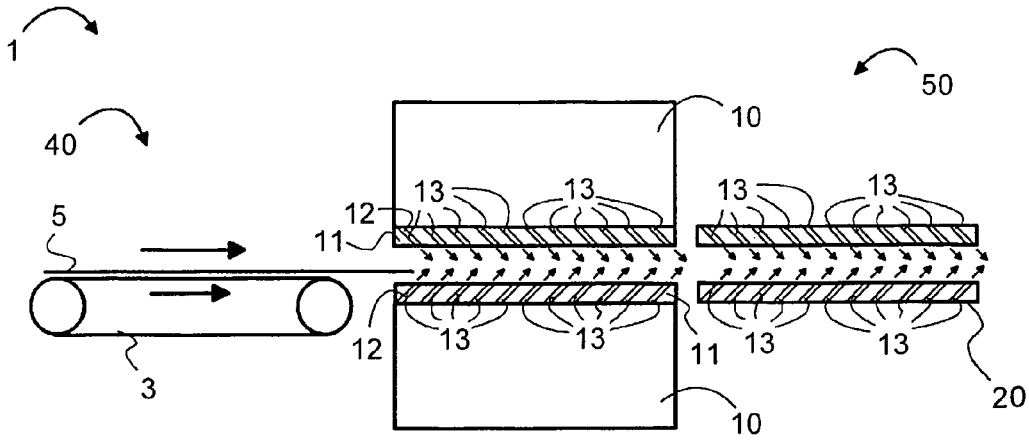

The following forms of embodiment of the invention represent examples and are described with reference to drawings. They show:

FIG. 1 a schematic plan view of a section of a transport belt transporting a printing material and comprising a heating arrangement and a cooling arrangement;

FIG. 2 a schematic plan view of a section of a transport belt transporting a printing material and comprising a heating arrangement that is inclined in transport direction;

FIG. 3. a schematic side elevation of a section of a heating arrangement and including a directed stream of cooling medium for transporting and controlling the velocity of the printing material.

FIG. 1 is a schematic plan view of a section of a continuous transport belt 3 which is moved in the direction indicated by the arrow and which transports a printing material 5. In so doing, transport belt 3 represents an example of a device 40 for guiding printing material 5 in a contacting manner. Additional devices for guiding printing material 5 in a contacting manner can be provided, in particular, transport belt 3 in combination with a gripper and/or a pushing element for grasping or pushing printing material 5. Transport belt 3, for example, may be provided with holes and, by means of an arrangement which creates a vacuum, may exert a force through the holes on printing material 5, said force pulling printing material 5 toward transport belt 3. In another example, transport belt 3 is configured so as to be electrostatic, in which case an electrostatic force pulls printing material 5 toward transport belt 3. Transport belt 3, ends, for example, in front of at least one heating arrangement 10, which is part of a fusing arrangement 1 for fusing toner to printing material 5. In accordance with one modification, inventive fusing arrangement 1 comprises a cooling arrangement 20 for cooling heated printing material 5 following the fusing process. A plurality of heating arrangements 10 may be provided. Fixing arrangement 1 may comprise other arrangements for heating and optionally applying pressure to printing material 5, for contact-fusing and contactless fusing of toner to printing material 5, potentially with continuous or discontinuous ultraviolet or infrared radiation or with heated fusion rollers. Printing material 5 is transported by transport belt 3 up to heating arrangement 10; there it is taken over by an air cushion arrangement and then passed through cooling arrangement 20 which follows heating arrangement 10. In this example, the air cushion arrangement represents an arrangement 50 for guiding printing material 5 in a non-contacting manner. Following cooling arrangement 20, viewed in transport direction, printing material 5 is transported further by adjoining transport rollers; specifically, said transport rollers are in contact with cooled strip-shaped areas of printing material 5. In heating arrangement 10, toner-carrying printing material 5 is heated by microwave radiation and, in so doing, the toner is fused to printing material 5. Therefore, fusing arrangement 1 is downstream of the printing mechanisms, or printing modules, of the printing machine which applies the printed image. Printing material 5 moves through heating arrangement 10 and is heated from the top and from the bottom by said arrangement so as to fuse the toner to printing material 5. After passing through heating arrangement 10, the fused toner on printing material 5 tends to smear. Therefore, printing material 5 subsequently passes through a cooling arrangement 20 which is configured so as to include specific cooling sections 21. In cooling arrangement 20, printing material 5 is cooled from a temperature of approximately 120° C. existing in heating arrangement 10, i.e., a temperature above the toner's glass transition temperature, to a temperature of below 70° C., i.e., a temperature below the toner's glass transition temperature. Printing material 5 is cooled exclusively in these cooling sections 21 of cooling arrangement 20; the other sections of printing material 5 located outside cooling sections 21 are not cooled. In FIG. 1, this status is shown by areas 22 represented in dotted lines on printing material 5. This section-by-section cooling of printing material 5 by means of cooling sections 21 creates cooled areas 22 in the sections in which cooling sections 21 have a cooling effect on printing material 5. In the example shown by FIG. 1, cooled areas 22 have the form of strips. These strips are created in that cooling sections 21 of cooling arrangement 20 cool printing material 5 section-by-section, i.e., in this case strip by strip, for a certain period of time from a starting point to an end point. Cooling sections 21 of cooling arrangement 20 preferably use cooling streams of air which are directed at printing material 5. The cooling medium, in this case a stream of air, is used effectively; only those areas of printing material 5, namely in cooled areas 22, are cooled, in that a cooling effect exists where required for fusing the toner to printing material 5. In this case, preferably only the printed areas of printing material 5 are cooled. Cooling power that is restricted for the fusing operation by fusing arrangement 1 can be used more effectively in this manner; the length of the cooling path can be reduced while the cooling performance remains the same. The cooling path is defined as the length of the interval in transport direction, during which printing material 5 is exposed to the cooling effect; this is substantially the length of cooling arrangement 20 in the transport direction of printing material 5. The printing machine rollers used for transporting printing material 5 following fusing arrangement 1 come into contact with cooled regions 22 of printing material 5, thereby preventing damage to the printed image. The non-cooled areas of printing material 5 outside the cooled areas 22 identified in FIG. 1 do not come into contact with any rollers. In a further development, the rollers for transporting printed material 5, which do come into contact with cooled areas 22, are cooled so as to be even more effective in excluding damage to the printed image. Another possibility of transporting printing material 5 following fusing arrangement 1, without damaging the printed image, provides that the rollers come into contact with lateral areas of printing material 5 that are outside the printed image, preferably with only one lateral area of printing material 5.

FIG. 2 shows a schematic plan view of an inventive form of embodiment of sections of transport belt 3 which transports printing material 5 in the direction of the arrow. In this example, transport belt 3 is divided into several strip-shaped sections 30, each of said sections extending upstream and downstream of heating arrangement 10, i.e., essentially extending up to heating arrangement 10. In this example, heating arrangement 10 is divided into four sections; they may be configured so as to represent individual heating arrangements 10. In this example, heating arrangement 10, which comprises a microwave field, is inclined perpendicular to the transport direction of printing material 5; in other words, heating arrangement 10 is aligned at an angle relative to the vertical of the transport direction of printing material 5 on the same plane as illustrated by FIG. 2. This means that heating arrangement 10 is tilted at an angle compared, for example, with the position of FIG. 1, and that various areas of the leading edge of printing material 5 reach heating arrangement 10 at different times. Different areas of printing material 5, which are on the same height relative to the transport direction, consequently are fused in heating arrangement 10 at different times, due to this inclined alignment of heating arrangement 10. Due to the inclination of heating arrangement 10, strip-shaped sections 30 of transport belt 3 terminate at different heights relative to the transport direction. FIG. 2 shows transport belt 3, for example divided in five strip-shaped sections 30 or segments which extend upstream of heating arrangement 10 and downstream of cooling arrangement 20, the ends of said sections or segments following—regarding their alignment with respect to heating arrangement 10—approximately the profile of the lateral surface of heating arrangement 10. Consequently, an imaginary connection of the ends of the segments of transport belt 3 results in approximately diagonal straight lines which extend parallel to the lateral surface of heating arrangement 10, i.e., upstream and downstream of heating arrangement 10. The design of fusing arrangement 1, as illustrated and described, has the advantage that printing material 5, in this case a sheet, is continuously carried by transport belt 3, that at all times at least one strip-shaped section 30 in front of heating arrangement 10 and one strip-shaped section 30 after cooling arrangement 20 is in contact with printing material 5 in order to carry said printing material. For example, in FIG. 2, a segment of transport belt 3 comes into contact with printing material 5 on the left side of heating arrangement 10 and a segment of transport belt 3 comes into contact with printing material 5 on the right side of cooling arrangement 20, and thus printing material 5 is reliably carried in transport direction. In so doing, transport belt 3 first comes into contact with areas of printing material 5 downstream of heating arrangement 10 (viewed in transport direction), because said areas are fused first due to the inclination of heating arrangement 10. At the end (viewed in transport direction), transport belt 3 comes into contact with areas of printing material 5 which are fused last due to the inclination of heating arrangement 10. Large areas of printing material 5 are not in contact with transport belt 3 at the same time so as to prevent smearing of the toner on the printed facing-away reverse side, which is placed on transport belt 3. This is of importance when the reverse side has already been printed and is heated again in heating arrangement 10. As a result of this, the printed image could be damaged by toner adhering to transport belt 3 or by undesirable shiny spots formed on printing material 5. Premature contact by transport belt 3 with the upper side or reverse side of printing material 5 downstream of heating arrangement 10 can damage the printed image on printing material 5. Such premature contact is prevented in that transport belt 3 comes into contact with printing material 5 after a specific interval when the temperature of the toner on printing material 5 is usually below the toner's glass transition temperature. Areas of printing material 5, in which the toner's glass transition temperature is exceeded because they have been heated and in which toner could potentially be smeared, are not contacted on the transport path as illustrated, and hence are guided in a contactless manner. The above-described form of embodiment reduces the length of the path required for fusing toner to printing material 5; i.e., fusing arrangement 1, in contrast with the conventional alignment of heating arrangement 10, can be designed in a more compact manner perpendicular to transport direction. Like heating arrangement 10, cooling arrangement 20 can be designed so as to be inclined perpendicular to the transport direction of printing material 5. In this case, cooling arrangement 20 is arranged downstream of heating arrangement 10, approximately parallel to said cooling arrangement. Consequently, in interaction with the inclined heating arrangement 10 as in FIG. 1, the above-described effect can be improved, and areas of printing material 5, which have been cooled earlier, can be grasped sooner by transport belt 30 downstream of cooling arrangement 20, while later cooled areas of printing material 5 are grasped later by transport belt 30 downstream of cooling arrangement 20, as described with reference to heating system 10.

FIG. 3 shows a sectional view of heating arrangement 10 and cooling arrangement 20 in another form of embodiment of the invention. Heating arrangement 10 is divided into a first upper part and a second lower part, whereby printing material 5 is passed between said parts. Printing material 5 is guided through heating arrangement 10, while the toner is firmly bonded to printing material 5. In this example of embodiment, printing material 5 is carried by transport belt 3 in the direction of the arrow as indicated. In the following situation, heating arrangement 10 comprises a resonator chamber of a microwave arrangement. The first part of heating arrangement 10, i.e., the upper part, has on its underside a layer of dielectric material; and the second part of heating arrangement 10, i.e., the lower part, has on its upper side a layer of dielectric material, whereby these layers face the interior side of heating arrangement 10. In the example, the dielectric material consists of polytetrafluoroethylene, also referred to as Teflon. Consequently, respectively one Teflon layer 11 is provided on opposing lateral surfaces of the first and second parts of heating arrangement 10, i.e., on the sides of the first and second parts that face printing material 5. The dielectric layer absorbs microwave radiation only minimally and affects the electromagnetic field only minimally. Inclined sections of injection elements 13 in Teflon layer 11 of the first and second parts of heating arrangement 10 and of cooling arrangement 20 form an arrangement 50 for the contactless transport of printing material 5, which said arrangement 50 transports printing material 5 when said printing material is guided through heating arrangement 10 and adjoining cooling arrangement 20. The ends of injection elements 13 have openings through which a stream of a cooling medium is injected in the direction of printing material 5 and into the space in heating arrangement 10, for example, a resonator chamber of a microwave arrangement, said stream carrying printing material 5. The stream of cooling medium, for example, consists of compressed air or is generated by fans. The inclined sections of injection elements 13 extend in transport direction of printing material 5, so that the stream of cooling medium, through injection elements 13, exerts a force in transport direction of printing material 5. In so doing, air cushion arrangement 12, on one hand, acts as a carrier for printing material 5 and, on the other hand, printing material 5 is pushed in transport direction and the velocity of printing material 5 is kept constant. Downstream of heating arrangement 10 is a cooling arrangement 20. Downstream of heating arrangement 10, printing material 5 is guided through a cooling arrangement 20, which comprises injection elements 13 for injecting a cooling medium, preferably air, which said cooling medium is directed as a targeted stream against printing material 5. Injection elements 13 in cooling arrangement 20 are inclined with respect to the transport direction. As a result of this, force is applied from the top, as well as from the bottom, in transport direction on printing material 5 which is passed through cooling arrangement 20. Force exerted by the stream from the bottom on printing material 5 carries said printing material, while force applied from the top represents a counter-force, thus stabilizing the transport path of printing material 5. The force acting in transport direction on printing material 5 causes the velocity of printing material 5 to remain constant because, without being guided by transport belt 3, the velocity of printing material 5 is reduced. The stream of cooling medium directed at printing material 5 is strong enough so that the velocity of printing material 5 is not reduced and so that the velocity of printing material 5 is controlled by cooling arrangement 20. The constant velocity of printing material 5 is important for a systematic sheet transport sequence during the printing process. In this manner, printing material 5 is transported by cooling arrangement 20, as well as cooled to below the toner's glass transition temperature, so that the transport of printing material 5 downstream of cooling arrangement 20 may be in a contacting manner and the toner on printing material 5 will not be smeared. Without this measure, the transfer of printing material 5 from transport belt 3 to heating arrangement 10 and on to cooling arrangement 20 would reduce the velocity of printing material 5. The force of the stream of cooling medium acting on printing material 5 in transport direction due to the inclined position of injection elements 13 of heating arrangement 10 and of cooling arrangement 20 does not reduce the sheet velocity. The action on printing material 5 is pulsed in transport direction of printing material 5. The constant velocity of printing material 5 is a prerequisite for uniform homogenous heating of printing material 5 and, ultimately, for good printing quality, because printing quality is related to the result of the fusing process to which printing material 5 is subjected. Furthermore, the constant velocity of the individual sheets ensures the appropriate succession of sheets in the paper path of the printing machine, as described above.

The invention claimed is:

1. A fusing apparatus for fusing toner onto a media, the apparatus comprising:

(a) a transport belt for transporting the media in a transport direction;

(b) a heating element through which the transport belt transports the media and positioned at a first angle relative to the transport direction;

(c) a plurality of downstream strips spaced along the belt on a downstream side of the heating element; and (d) a plurality of upstream strips spaced along the belt on an upstream side of the heating element; wherein, during at least a portion of the transport, at least one downstream strip and at least one upstream strip are in continuous contact with the medium.

2. A fusing apparatus as in claim 1 further comprising (e) a cooling element through which the transport belt transports the media and positioned at the first angle relative to the transport direction; the plurality of downstream strips are downstream of the cooling element; and, during at least during a portion of the transport, one downstream strip and at least one upstream strip are in continuous contact with the media.

3. The fusing element as in claim 1, wherein the plurality of upstream strips each include a first endpoint and a second endpoint and two or more ends of the first endpoints terminate at an angle parallel or substantially parallel to the first angle.

4. The fusing element as in claim 3, wherein the plurality of downstream strips each include a first endpoint and a second endpoint and two or more of the first endpoints terminate at an angle parallel or substantially parallel to the first angle.

5. The fusing element as in claim 1, wherein, at one particular instance of time, a leading edge of the media contacts only one downstream strip and a tailing edge contacts only one upstream strip.

6. The fusing element as in claim 2, wherein the plurality of upstream strips each include a first endpoint and a second endpoint and two or more ends of the first endpoints terminate at an angle parallel or substantially parallel to the first angle.

7. The fusing element as in claim 6, wherein the plurality of downstream strips each include a first endpoint and a second endpoint and two or more of the first endpoints terminate at an angle parallel or substantially parallel to the first angle.

8. The fusing element as in claim 2, wherein, at one particular instance of time, a leading edge of the media contacts only one downstream strip and a trailing edge contacts only one upstream strip.

* * * * *